US010794057B2

(12) United States Patent
Ceccacci

(10) Patent No.: US 10,794,057 B2
(45) Date of Patent: Oct. 6, 2020

(54) FALSE CEILING SYSTEM

(71) Applicant: OC S.R.L., Pontinia (IT)

(72) Inventor: Gerardo Ceccacci, Pontinia (IT)

(73) Assignee: OC S.R.L., Pontinia (IT)

( * ) Notice: Subject to any disclaimer, the term of this patent is extended or adjusted under 35 U.S.C. 154(b) by 0 days.

(21) Appl. No.: 16/097,484

(22) PCT Filed: Apr. 21, 2017

(86) PCT No.: PCT/IT2017/000081
§ 371 (c)(1),
(2) Date: Oct. 29, 2018

(87) PCT Pub. No.: WO2017/191662
PCT Pub. Date: Nov. 9, 2017

(65) Prior Publication Data

US 2019/0145100 A1 May 16, 2019

(30) Foreign Application Priority Data

May 3, 2016 (IT) ..... 102016000044959

(51) Int. Cl.

| | |
|---|---|
| ***E04B 9/24*** | (2006.01) |
| ***E04B 9/12*** | (2006.01) |
| *E04B 9/06* | (2006.01) |
| *E04C 3/04* | (2006.01) |

(52) U.S. Cl.
CPC ..... *E04B 9/241* (2013.01); *E04B 9/127* (2013.01); *E04B 9/245* (2013.01); *E04B 9/064* (2013.01); *E04C 2003/0452* (2013.01)

(58) Field of Classification Search
CPC ..... E04B 9/241; E04B 9/127; E04B 9/064; E04B 9/242; E04B 9/26; E04B 2009/062; E04B 9/10; E04B 9/12; E04B 9/24; E04B 9/245; E04C 2003/0452; E04C 2003/046
USPC ..... 52/506.06, 39, 474, 506.01, 506.05, 52/506.07, 506.08, 665, 772, 774; 248/220.21, 220.22
See application file for complete search history.

(56) References Cited

U.S. PATENT DOCUMENTS 4,408,428 A * 10/1983 Brooke ..... E04B 9/242 52/506.07
4,937,994 A * 7/1990 Ritter ..... E04B 9/02 52/506.07
4,944,129 A * 7/1990 Hartleif ..... E04B 9/064 52/474

(Continued)

FOREIGN PATENT DOCUMENTS

DE 3247505 A1 * 7/1984 ..... E04B 9/064
DE 8810409 U1 9/1988

(Continued)

OTHER PUBLICATIONS

International Search Report and Written Opinion for PCT/IT2017/000081 dated Aug. 23, 2017.

*Primary Examiner* — Ryan D Kwiecinski
*Assistant Examiner* — Matthew J Gitlin
(74) *Attorney, Agent, or Firm* — Thomas|Horsetemyer LLP

(57) ABSTRACT

The present invention relates to a false ceiling mounting system that is simple and effective, while also allowing quick disassembly for inspection or total removal. To this end, a section bar with resilient tabs is provided, the false ceiling panel being fit between two section bars.

15 Claims, 8 Drawing Sheets

(56) References Cited

U.S. PATENT DOCUMENTS

| | | | | | |
|---|---|---|---|---|---|
| 5,313,759 | A * | 5/1994 | Chase, III | E04B 9/02 | 52/39 |
| 5,349,800 | A * | 9/1994 | Peng | E04B 9/127 | 403/174 |
| 5,359,826 | A * | 11/1994 | Grearson | E04C 3/07 | 403/363 |
| 5,417,025 | A * | 5/1995 | Nute | E04B 9/26 | 52/483.1 |
| 6,701,686 | B1 * | 3/2004 | Platt | E04B 9/02 | 52/506.07 |
| 2001/0032433 | A1 * | 10/2001 | Harris | E04B 9/127 | 52/506.06 |
| 2005/0226683 | A1 * | 10/2005 | Herb | E04B 9/127 | 403/230 |
| 2009/0178358 | A1 * | 7/2009 | Boyd | E04B 9/02 | 52/489.2 |
| 2014/0245687 | A1 * | 9/2014 | Grandi | E04B 9/006 | 52/506.05 |
| 2017/0292269 | A1 * | 10/2017 | Tornqvist | E04B 9/242 | |

FOREIGN PATENT DOCUMENTS

| | | | |
|---|---|---|---|
| DE | 202006001416 | U1 | 4/2006 |
| JP | H11303299 | A | 11/1999 |
| JP | 2001227096 | A | 8/2001 |

* cited by examiner

FALSE CEILING SYSTEM

CROSS-REFERENCE TO RELATED APPLICATION

This application is the 35 U.S.C. § 371 national stage application of PCT Application No. PCT/IT2017/000081, filed Apr. 21, 2017, where the PCT claims the priority to and benefit of Italian Patent Application No. 102016000044959, filed May 3, 2016, both of which are herein incorporated by reference in their entireties.

The present invention relates to a false ceiling mounting system.

More precisely, the present invention relates to a false ceilings mounting system that is simple and effective, while also allowing quick disassembly for inspection or total removal. To this end, a section bar with resilient tabs is provided, the false ceiling panel being fit into between two section bars.

PRIOR ART

Referring to FIGS. 1 to 3, some ceiling systems 100 are mounted using inverted "T" section bars 120. On the stem 125 of the T, clips 110 are mounted. Between two of these sections/clips the panel 130 is inserted, which rests on the base 122 of the section 120, so that the elastic force keeps it in position. In fact, the clip 110 has a first end 111 that pushes on the panel, a winding 112 mounted between the panel and the stem 125, and a second end 113 that is perpendicular to said first end, which is accommodated in a recess 121 on the stem 125.

A similar solution is provided in the patent application JP2001227096A, where the clips always push the panel from the top, or on its larger surfaces. Or, as in the solution provided in DE202006001416U1, the springs push one edge of the panel but the clip is configured in such a way that does not allow to insert the top panel, a complicated maneuver being required to lock them against the clips.

These solutions are completely inappropriate. In fact, the clips often snap, making the assembly work long and difficult, and the result is precarious. In addition, the mounting system is not always reversible: once the panels have been mounted, at times, it is needed to break them to be able to remove them.

It is therefore an object of the present invention to provide a system for false ceiling assembling which solves the problems and overcomes the drawbacks of and provide an alternative to traditional solutions.

It is object of the present invention a system according to the annexed claims, which form an integral part of the present description.

The invention will be now described, for illustrative but not limitative purposes, with particular reference to the figures of the accompanying drawings, in which.

DETAILED DESCRIPTION OF EXAMPLES OF THE INVENTION

Figure 1:
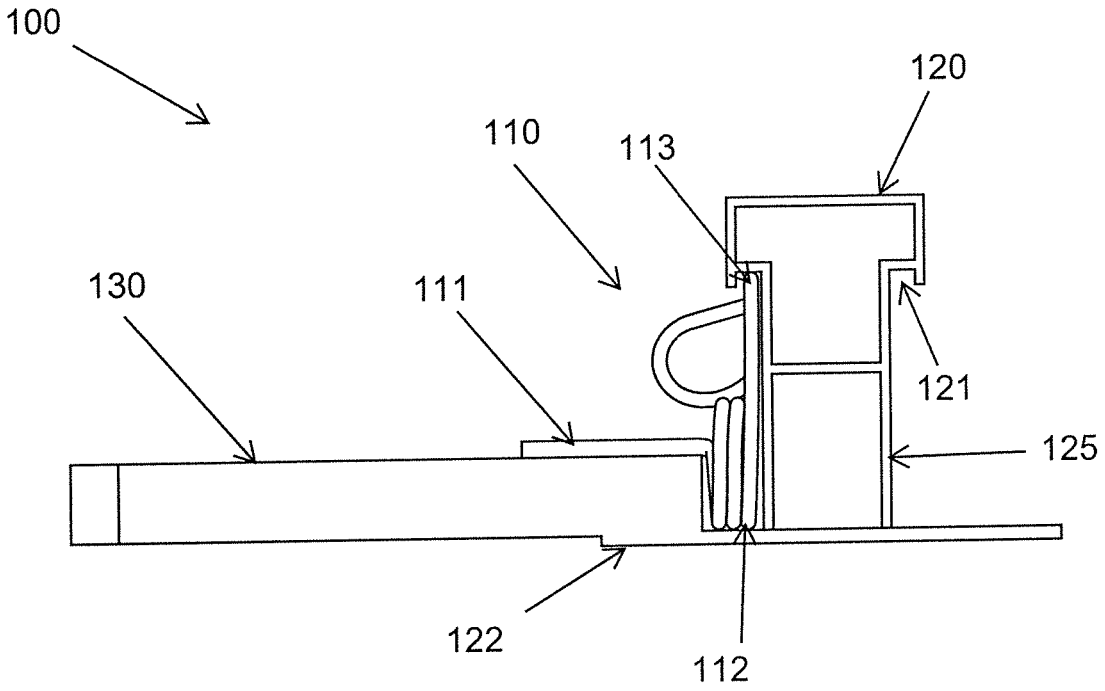
FIG. 1 shows a side view of a false ceiling mounting system according to the prior art.
Figure 2:
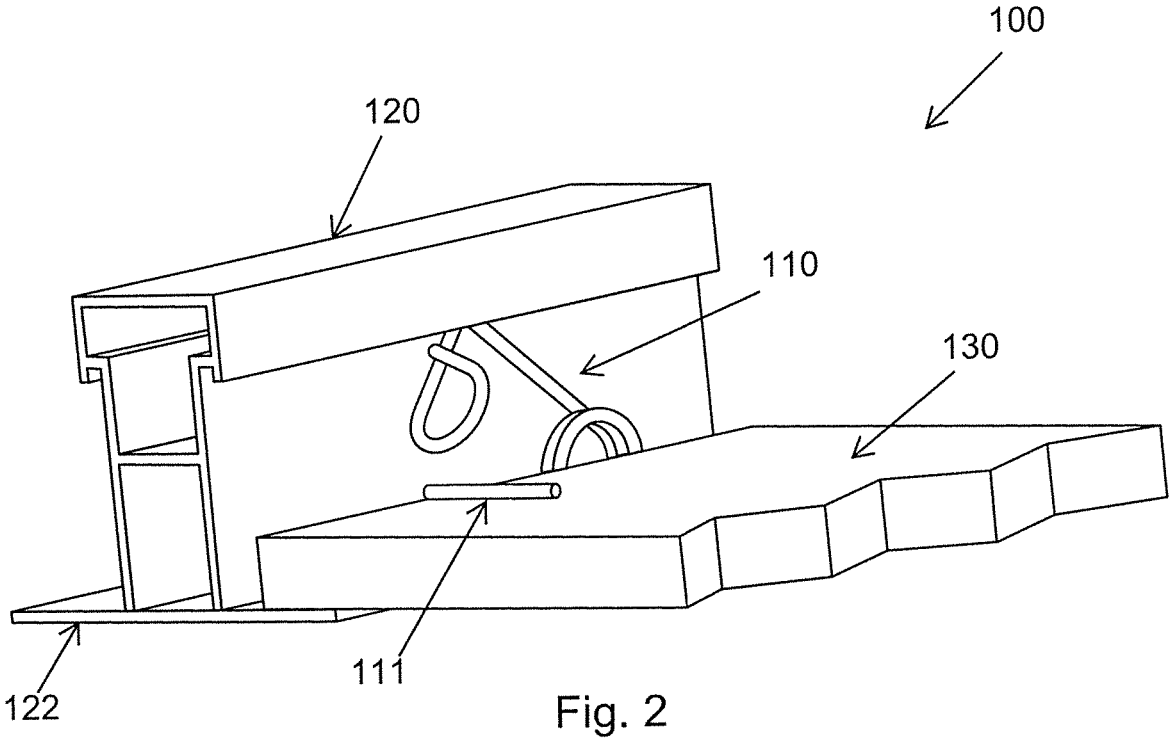
FIG. 2 shows a perspective view of the mounting system of FIG. 1.
Figure 3:
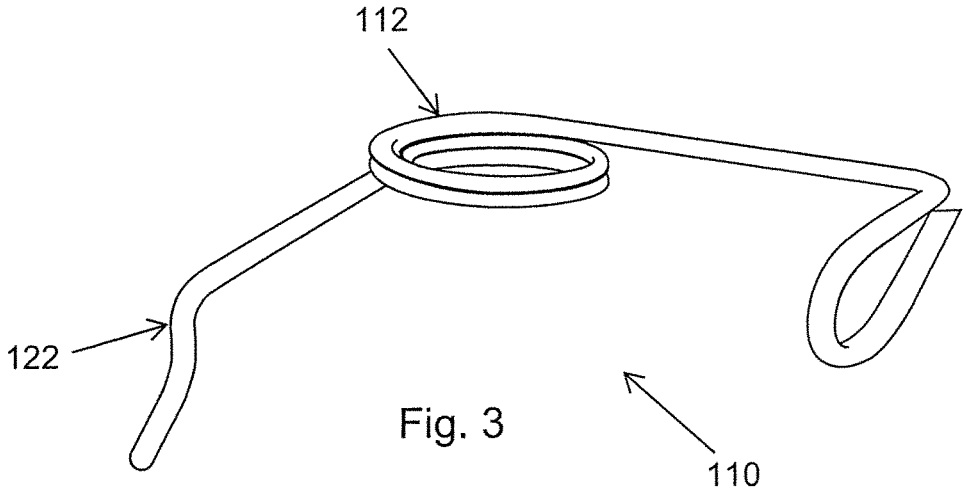
FIG. 3 shows a mounting element of the mounting system of FIG. 1 or 2.
Figure 4:
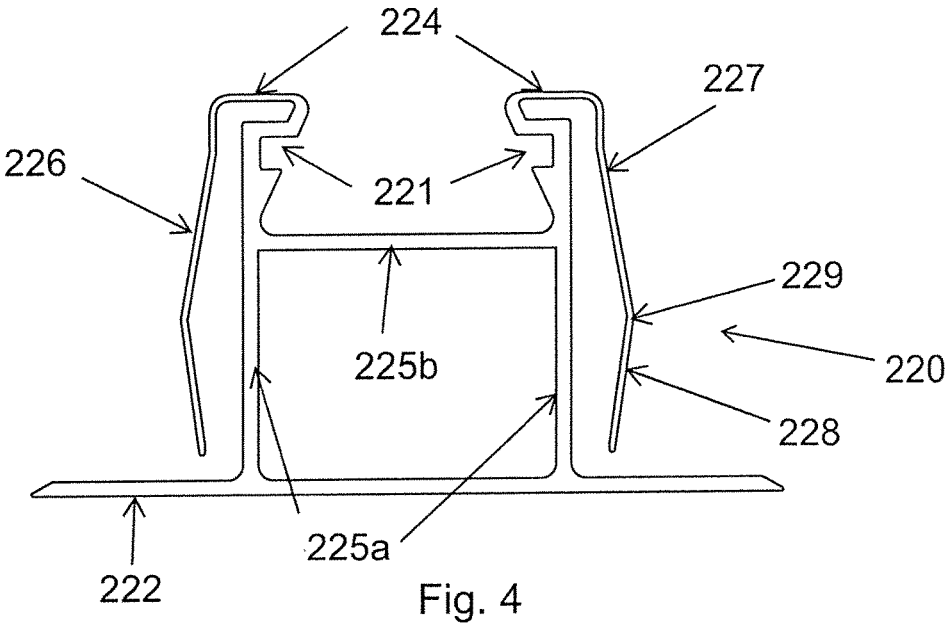
FIG. 4 shows a cross section of a section bar used in the system according to the invention.
Figure 5:
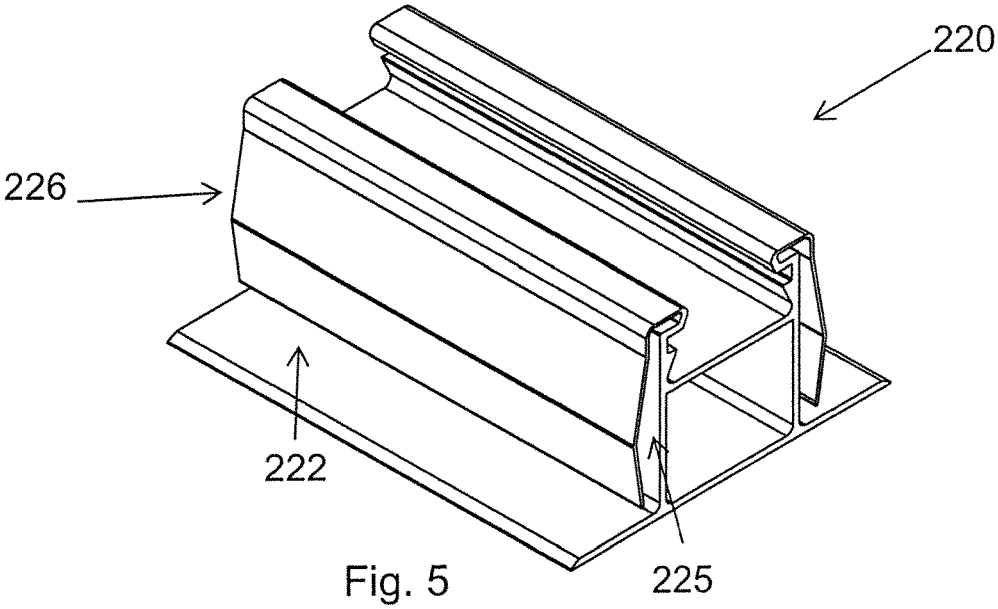
FIG. 5 shows a perspective view of the section of FIG. 4.

Everywhere in this description and in the appended claims the case is included wherein the word "it comprises" is replaced by the word "it consists of". In addition, elements of the embodiments can be extracted from them and used also independently of the other elements and details.

In reference to FIGS. 4 to 11, the system 200 according to the invention is described in detail. It is composed of section bars 220 and 240 between which 230 panels are to be inserted.

The single section bar 220 is composed of a base 222 on which a vertical body 225 stands, which is composed by two 225*a* vertical walls joined by a transverse wall 225*b* (however, in an embodiment, on the base a vertical body with a single wall, or with more than two vertical walls stands). At the upper end of such vertical walls 225*a* are integrally formed two resilient tabs 226 that extend downward at the side of said vertical walls 225*a*, out of the tube 225. The tabs 226 are formed by a first portion 227 and a second portion 228 as a continuation of the first portion. The portions 227, 228 are arranged so as to form between them an obtuse angle towards the outside in correspondence of the contact point 229, i.e. in the direction parallel to the vertical walls 225*a*, away from them, thus forming a convexity in the direction away from the wall. A connecting portion 224 connects the first portion 227 to the respective vertical wall 225*a*.

Figure 6:
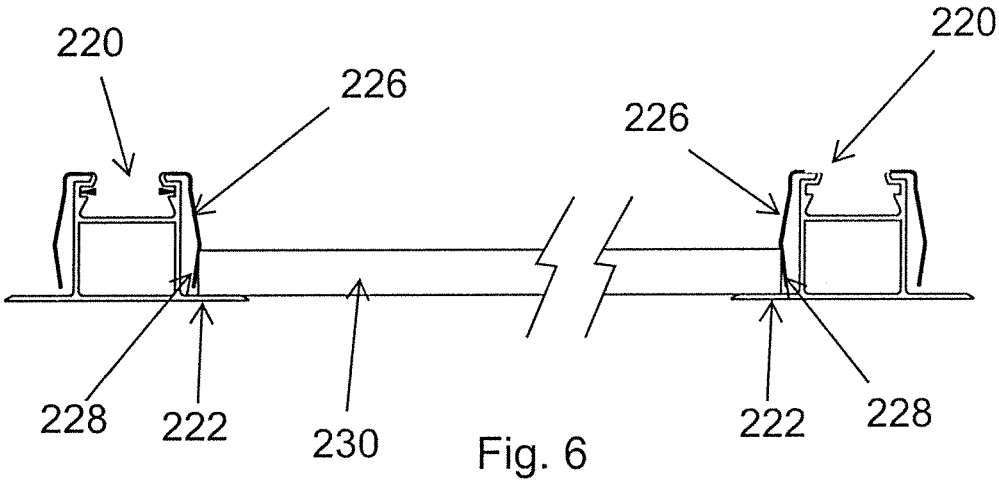
FIG. 6 shows the operation of the false ceiling mounting system according to an aspect of the invention.

In this way, as it can be seen in FIG. 6, the panel 230 is pushed in between the lugs 226 of two sections 220 until it is fit in between the respective second portions 228, in such a way that said obtuse angle creates (elastic) resistance to disassembly of the panel. Obviously, by acting on the (elastic) tabs, you can easily remove the panel, but this can not happen without an external intervention. It is also possible to disassemble it if enough pressure from below is applied.

The panels 230 are dimensioned in such a way as to push said second portions 228 so as to obtain the described locking effect, at least between two parallel section bars.

Figure 7:
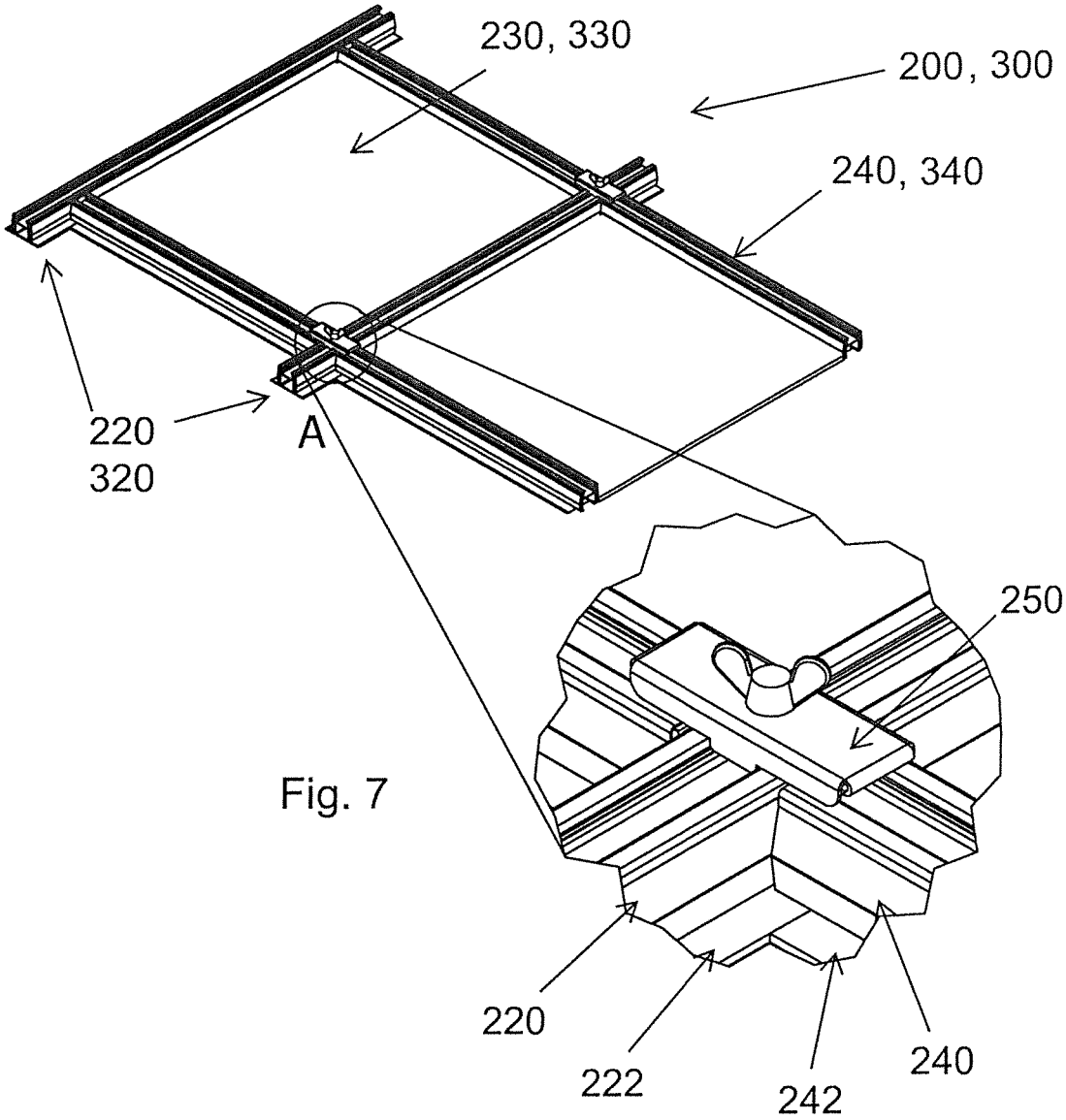
FIG. 7 shows a portion of ceiling mounted according to the invention, in which an enlargement of a detail of the junction between transverse section bars is illustrated as well, according to an aspect of the invention.

Referring also to FIG. 7, it is observed that one uses two types of sections 220 and 240 only slightly different from each other. The difference lies in the fact that at least the base 242 does not extend to the longitudinal end of the section, contrary to what base 222 does. This is to allow to place the transverse section bar 240 onto the base 222 of the section bar 220 in such a way that they are at the same height.

Figure 8:
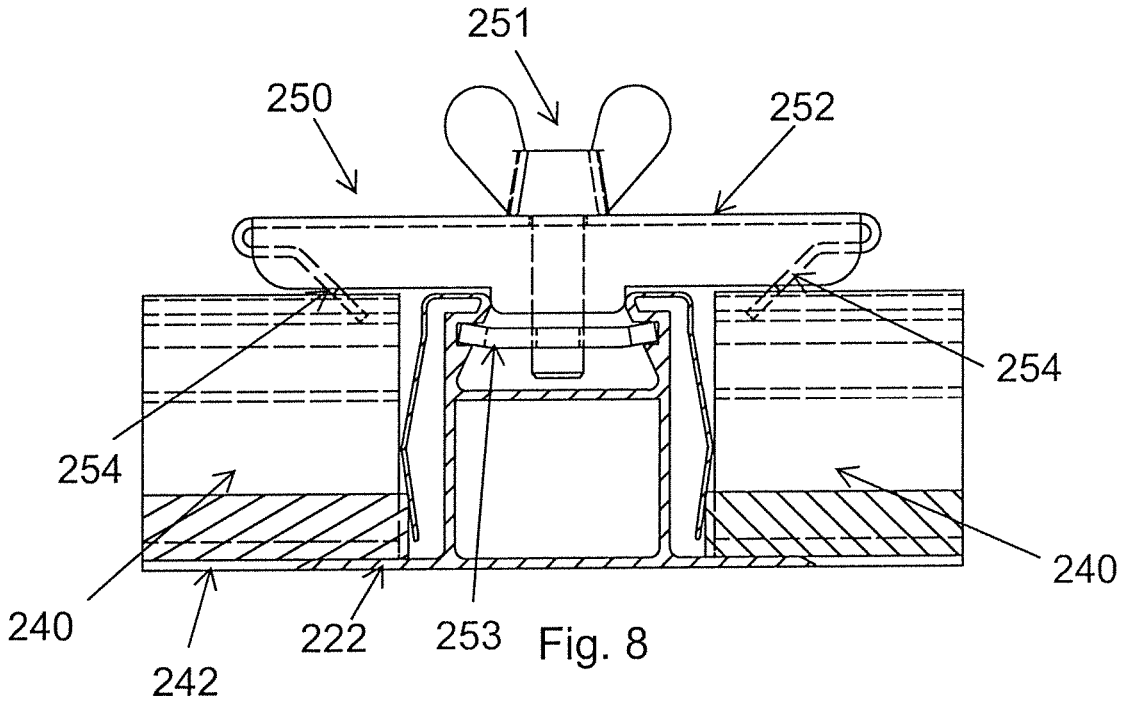
FIG. 8 shows a ceiling element of FIG. 7 (terminal)
Figure 9:
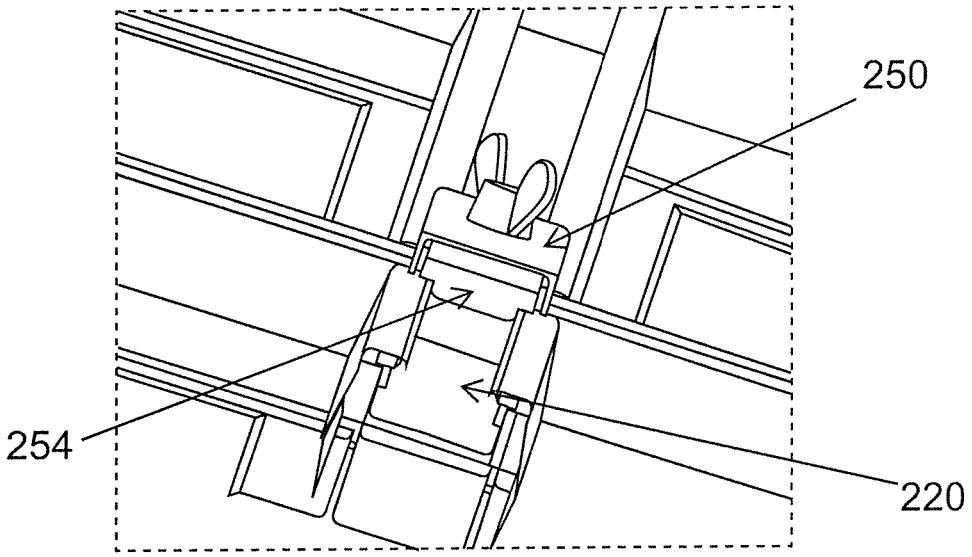
FIG. 9 shows the action of the clamp of FIG. 8, in perspective.
Figure 10:
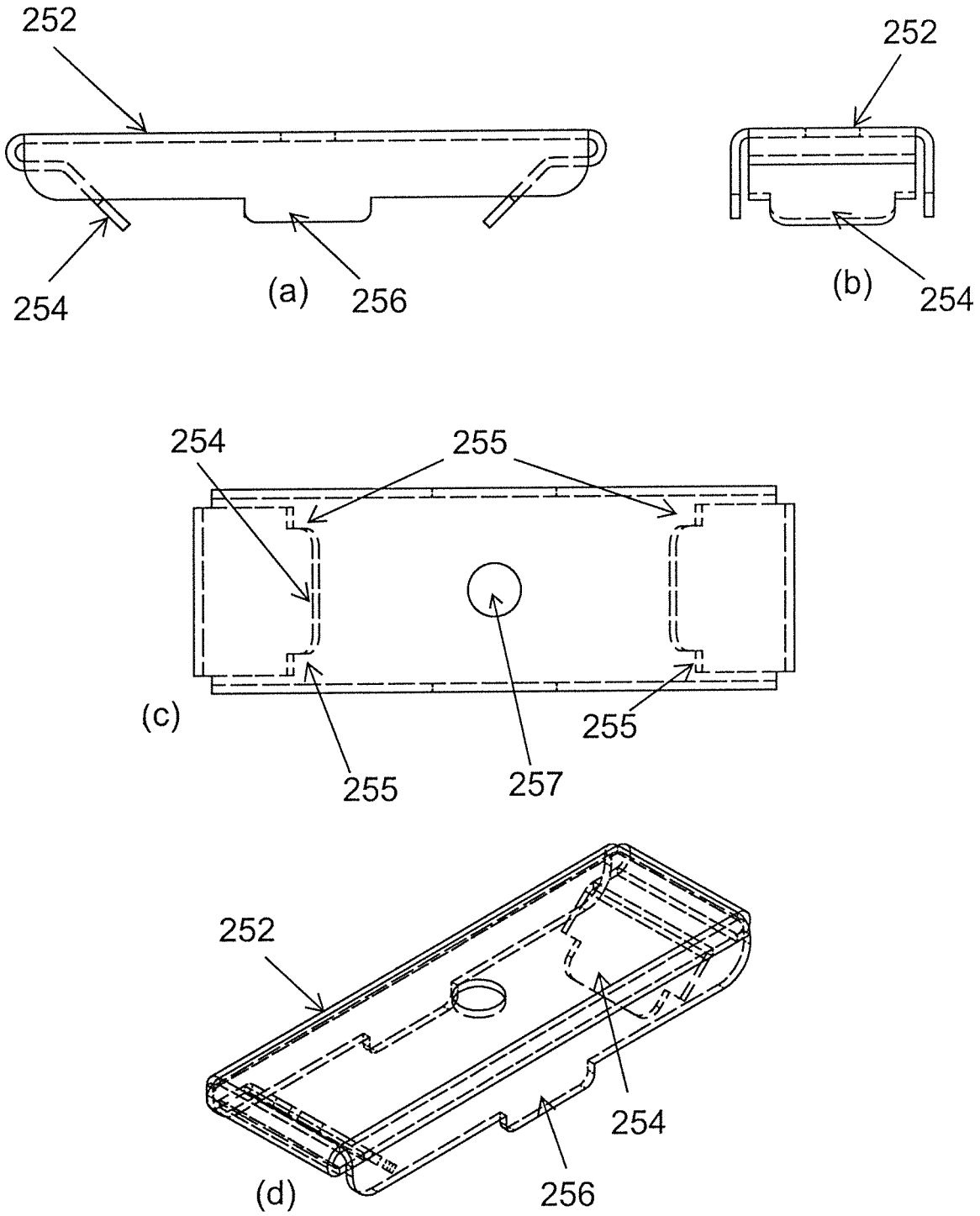
FIG. 10 shows in (a) a first side view, in (b) a second side view, in (c) a top view, and in (d) a perspective view of the clamp of FIGS. 8 and 9.
Figure 11:
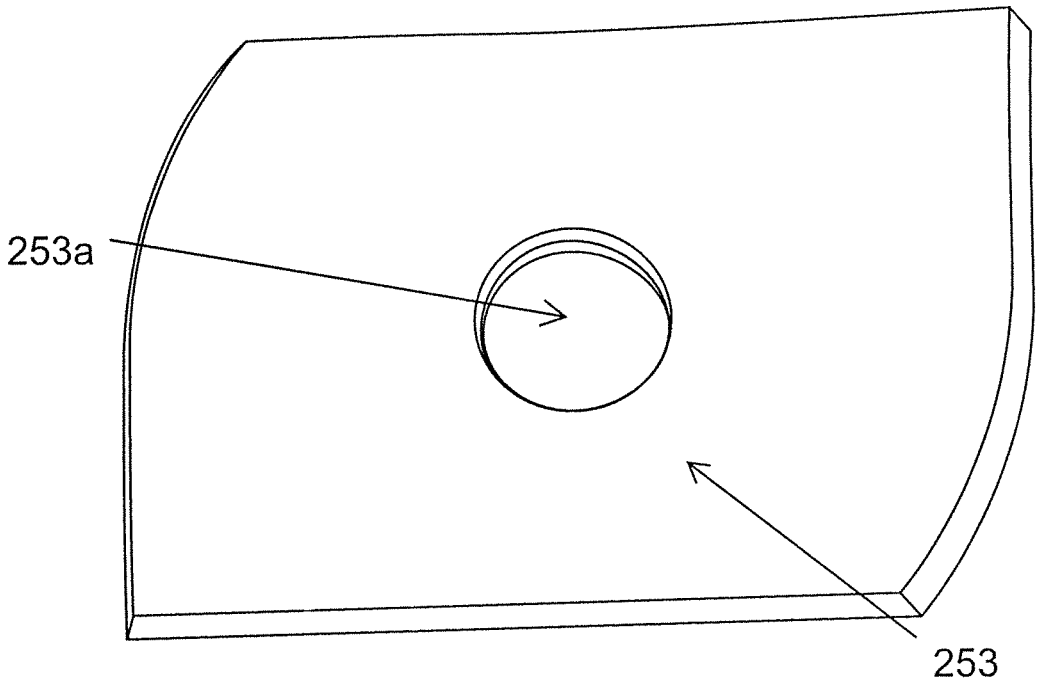
FIG. 11 shows an example of a stud for use with the clamping means of FIGS. 8 to 10.

The clamp 250 secures the coupling between the section bars 240 and 220. It includes an elongated body 252 that is disposed in the direction of the transverse section 240. It includes a hole 257 through which a clamping screw 251 passes, which is screwed on an almost flat element of approximately rectangular or rectangular shape 253 (cross-bar, housed free or fixed element that connects the two vertical walls, cf. FIG. 11) with a threaded central bore 253*a*. The ends of the element 253 engage in the internal grooves 221 facing the section bar 220, in such a way that, by tightening the screw 251, the body 252 make pressure onto the section bar 220 and onto the two transverse section bars 240 placed at the side (to rest on the base 222), making the whole as integral. At its longitudinal ends, the body 252 has a tab 254 (preferably flexible) which enters above the section bar element 240 and is directed towards the section bar element 220, so as to improve the fixing pressure. The tab 254 laterally has two notches 255 which rest on the section bar element 240. The side tab 256 enters from above into the section bar 220 as shown in FIG. 8. These steps and these tabs, although optional, have the task of putting at right angles the section bar elements 220, 240, and thus compensate for any misalignment and mounting tolerances. These steps and tabs naturally are configurable depending on the shape of the section bar, in the figures a choice for open sections in the upper end vertical end is shown.

The clamp in its most general form comprises means for fixing the two section bars 220 and 240 arranged transversely. In particular, said fixing means comprise an elongated body 252 with a hole 257 through which a clamping screw 251 passes, which is adapted to be screwed, in use, into a threaded hole, which can be provided on the section bar element (for example in the element 225*b*) or on an element housed in the section bar (for example in the cross-bar 253). The elongate body 252 is configured to push, in use, at least one transverse section bar 240 toward the base 222.

Figure 13:
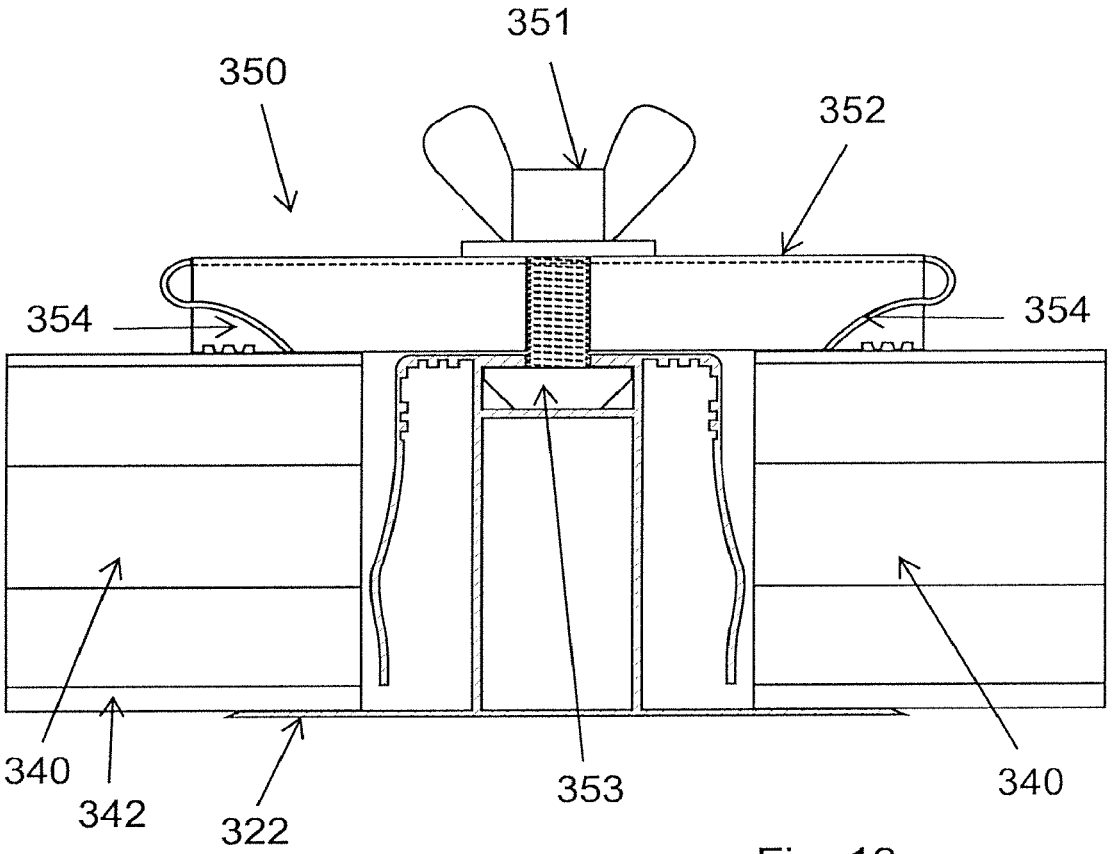
FIG. 13 shows a mounting section of the system according to the invention, in a different embodiment.
Figure 12:
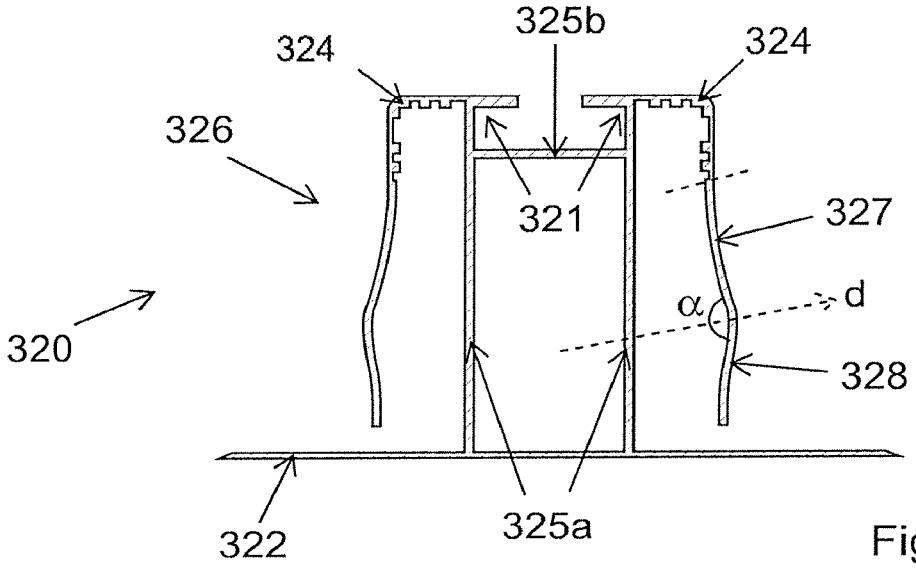
FIG. 12 shows a different embodiment of the section bar according to the preceding figures.
Figure 14:
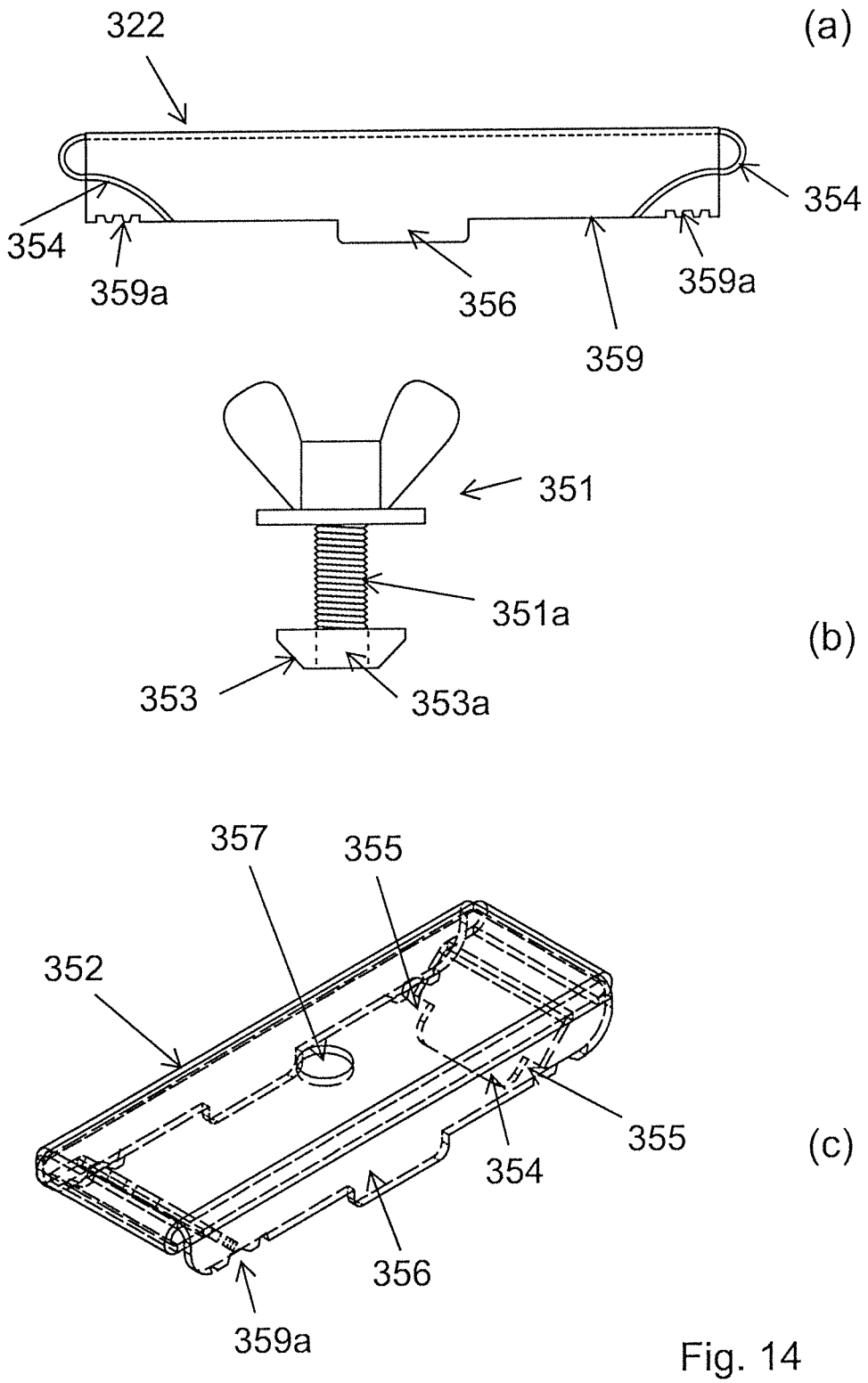
FIGS. 14 (*a*)-(*c*) show a different embodiment of the clamping means and the cross-bar of the previous figures.

With reference to FIG. 12-14, it illustrates a different embodiment. The 3xx numerical references correspond to the reference numerals 2xx of the previous embodiment, and therefore functional structural explanations will not be repeated except for the most important differences.

It is noted that in this embodiment the crossbar 353 has a slightly different shape, adapted to be coupled to the different shape of the grooves 321. With "groove" here is meant both a groove and an angle as shown in FIG. 12, or any other shape with at least two walls at a certain angle between them.

In FIG. 12, the contact points of the different portions 324, 327 and 328 of resilient tabs 326 are shown in dashed. The second portion 327 and the third portion 328 form an obtuse angle D. The direction of this angle is denoted by "d", which ideally intersects the wall 325*a* and moves away from the section bar element, forming with the base 322 an acute angle from 0 to 80° approximately, preferably between 0 and 45°, still more preferably between 0 and 20°. Regardless of the angle, it is important that it is a direction that does not clearly point towards the base 322 in such a way that it does not point, in use, towards the mounted panel. All this applies, although not shown, also for the first embodiment.

It is indicated with 359 a side of the elongate body 322 which in use is directed to the section bar. The side 359 has one or more knurls 359*a* configured to make better grip on the section bar. The tab 354 (preferably flexible) laterally has two notches 355 which rest on the section bar element 340, and on these steps other knurls are optionally placed, on one or both sides of the step. The tab 354 may protrude or not downwards with respect to the edge 359.

The clamping screw 351 is shown which has a trunk in which a thread 351*a* is provided.

The structure obtained by the mutual fixing of sections 220 and 240 is supported/fixed to perimeter references of the room wherein the ceiling (not shown) is to be mounted. These perimeter references may be simple "L"-shaped supports. At this point, the panels 230 are inserted between the section bar elements obliquely and then are lowered until they rest against the first portions 227. One continues to lower them until the tabs 226 snap and the panels are fixed between the second portions 228, fixing the panels themselves. The lowering of the panels can be done conveniently with suction cups.

The disassembly of the panels takes place, on the contrary, by pushing them upwards and then removing them obliquely. At that point, one can easily access the fastening screws 251 acting on which one can dismantle the whole structure.

In this way, one gets a simple and reversible system for mounting and dismounting a false ceiling. The clamp 250 can also be used independently in current systems for false ceilings. Not only that, it can also be substituted in the above-described system by other known or future means for the fixing of the transverse section bars.

The system according to the invention, in addition to being simple and reversible, allows to put at right angles all the elements, realizing a stable and regular false ceiling.

In the foregoing, preferred embodiments of the present invention have been suggested as well as variants of the present invention have been described, but it is to be understood that those skilled in the art can make modifications and changes, without so departing from the related scope of protection, as detabed by the attached claims have been described attached.

The invention claimed is:

1. A false ceiling system, comprising:

one or more panels having a perimeter with at least two opposite and parallel sides;

a plurality of first inverted-T-shaped section bars having a direction of longitudinal extension, each inverted-T-shaped section bar comprising:

a base;

a vertical body comprising at least one vertical wall with a first vertical wall end, a second vertical wall end opposite to said first vertical wall end, and two resilient tabs integrally formed as part of the vertical body, wherein the first vertical wall end is fixed to said base, the two resilient tabs extend downward on opposite sides of said vertical body along said direction of longitudinal extension, wherein each of said two resilient tabs comprises:

a first portion with a first end and a second end, the first portion formed with a bend, wherein the first end is fixed to said second vertical wall end having an elbow at an intersection of the first end of the first portion and the second vertical wall end, and the second end of the of the first portion is oriented towards said base;

a second portion extends from said first portion; and a third portion extends from said second portion, said second portion and said third portion being inclined with respect to each other in such a way as to form an obtuse angle with convexity between the second and the third portion in a direction away from said vertical body;

wherein:

fastening means are comprised for fastening a first inverted-T-shaped section bar and at least one second inverted-T-shaped section bar transversely to one another, and said one or more panels are dimensioned in such a way that, in use, push, on said at least two opposite and parallel sides, against the third portion of respective resilient tabs opposite in the direction of said base.

2. The false ceiling system according to claim 1, wherein:

said vertical body of said first inverted-T-shaped section bar comprises two opposing vertical walls;

said two vertical walls have two respective facing grooves adapted to accommodate the opposite ends of a cross-bar with a threaded hole;

said fastening means comprise an elongated body with a hole through which a clamping screw passes, which is adapted to be screwed, in use, into said threaded hole; and said elongated body being configured to push, in use, said at least one second inverted-T-shaped section bar toward said base.

3. The false ceiling system according to claim 2, wherein:

said vertical body of said at least one second inverted-T-shaped section bar has an end opposite to said base, said opposite end being formed by two opposite walls that form an open space in the direction that moves away from the base; and said elongated body further comprises transverse projections integrally formed as part of the elongated body, which, in use, penetrate into said opposite end so as to ensure squaring of said at least one second inverted-T-shaped section bar.

4. The false ceiling system according to claim 2, wherein:

said vertical body of said first inverted-T-shaped section bar has an end opposite to said base, said opposite end being formed by two opposite walls that form an open space in the direction that moves away from the base; and said elongated body further comprises lateral protrusions integrally formed as part of the elongated body, which, in use, penetrate into said opposite end so as to ensure a square angle positioning of said first section bar.

5. The false ceiling system according to claim 4, wherein said elongated body presents knurls on an edge facing, in use, towards an interior of said inverted-T-shaped section bar configured to improve the grip of said at least one second inverted-T-shaped section bar.

6. The false ceiling system according to claim 1, wherein:

said vertical body of said first inverted-T-shaped section bar comprises two opposing vertical walls;

said two opposite vertical walls are connected together by a transverse element provided with a threaded hole;

said fastening means comprise an elongated body with a hole through which a clamping screw passes, which is adapted to be screwed, in use, into said threaded hole; and said elongated body being configured to push, in use, said at least one second inverted-T-shaped section bar toward said base.

7. The false ceiling system according to claim 1, wherein the fastening means further comprises a fastening device, the fastening device comprises:

an elongated body comprising transverse projections integrally formed as part of the elongated body and a hole through the elongated body adapted to receive a clamping screw, the clamping screw adapted to be screwed, into a hole provided in said vertical body of one of said plurality of first inverted-T-shaped section bars, the transverse projections configured to penetrate into said at least one second inverted-T-shaped section bar arranged transversely to said first inverted-T-shaped section bars so as to ensure square angle positioning of said at least one second inverted-T-shaped section bar, and said elongated body configured to push, in use, the at least one second inverted-T-shaped section bar toward said base of at least one of said plurality of first inverted-T-shaped section bars.

8. The false ceiling system according to claim 7, wherein said vertical body of said first section comprises two opposing vertical walls connected by or which accommodate a cross-bar which includes said hole.

9. The false ceiling system according to claim 7, wherein said elongated body presents knurls on an edge facing, in use, towards an interior of said inverted-T-shaped section bar, which are configured to improve the grip of said second inverted-T-shaped section bar.

10. The false ceiling system according to claim 7, wherein the transverse projections are configured to flex with respect to the elongated body.

11. A method of assembling a false ceiling utilizing a false ceiling system, wherein the false ceiling system comprises:

one or more panels having a perimeter with at least two opposite and parallel sides;

a plurality of inverted-T-shaped section bars having a direction of longitudinal extension and comprising:

a base;

a vertical body comprising at least one vertical wall with a first vertical wall end, a second vertical wall end opposite to said first vertical wall end, and two resilient tabs integrally formed as part of the vertical boy, wherein the first vertical wall end is fixed to said base, the two resilient tabs extend downward on opposite sides of said vertical body along said direction of longitudinal extension, wherein each of said two resilient tabs comprises:

a first portion with a first end and a second end, the first portion formed with a bend, wherein the first end is fixed to said second vertical wall end having an elbow at an intersection of the first end of the first portion and the second vertical wall end, and the second end is oriented towards said base;

a second portion extends from said first portion; and a third portion extends from said second portion, said second portion and said third portion being inclined with respect to each other in such a way as to form an obtuse angle with convexity between the second and the third portion in a direction away from said vertical body;

wherein fastening means are comprised for fastening a first inverted-T-shaped section bar and at least one second inverted-T-shaped section bar transversely to one another, and said one or more panels are dimensioned in such a way that, in use, push, on said at least two opposite and parallel sides, against the third portion of respective resilient tabs opposite in the direction of said base;

the method comprising the following steps:

mounting said plurality of first and second inverted-T-shaped section bars to a ceiling by using said fastening means for fixing at least a first inverted-T-shaped section bar to at least a second inverted-T-shaped section bar arranged transversely;

for each panel:

placing the panel between at least two opposite inverted-T-shaped section bars of said plurality of first and second inverted-T-shaped section bars, in correspondence with the respective first portions of resilient tab; and pushing the panel until clamped between respective second portions.

12. The method according to claim 11, wherein the step of pushing the panel is performed using suction cups on the side of the panel opposite to the ceiling.

13. The method according to claim 11, wherein:

said vertical body of said first inverted-T-shaped section bar comprises two opposing vertical walls;

said two vertical walls have two respective facing grooves adapted to accommodate the opposite ends of a cross-bar with a threaded hole;

said fastening means comprise an elongated body with a hole through which a clamping screw passes, which is adapted to be screwed, in use, into said threaded hole; and said elongated body being configured to push, in use, said at least one second inverted-T-shaped section bar toward said base.

14. The method according to claim 13, wherein:

said vertical body of said at least one second inverted-T-shaped section bar has an end opposite to said base, said opposite end being formed by two opposite walls that form an open space in the direction that moves away from the base; and said elongated body further comprises transverse projections integrally formed as part of the elongated body, which, in use, penetrate into said opposite end so as to ensure squaring of said at least one second inverted-T-shaped section bar.

15. The method according to claim 14, wherein the transverse projections are configured to flex with respect to the elongated body.

* * * * *